US005697191A

United States Patent [19]

MacKarvich

[11] Patent Number: 5,697,191

[45] Date of Patent: Dec. 16, 1997

[54] MANUFACTURED HOME STABILIZING FOUNDATION SYSTEM

[76] Inventor: Charles J. MacKarvich, 1720 Tyler Green Trail, Smyrna, Ga. 30080

[21] Appl. No.: 629,834

[22] Filed: Apr. 10, 1996

[51] Int. Cl.[6] ..... E02D 27/00

[52] U.S. Cl. ..... 52/169.9; 52/DIG. 11; 52/146

[58] Field of Search ..... 52/169.9, DIG. 11, 52/23, 148, 146, 299, 155, 156, 157

[56] References Cited

U.S. PATENT DOCUMENTS

| | | | |
|---|---|---|---|
| 3,747,288 | 7/1973 | Grimelii | 52/23 |
| 3,751,866 | 8/1973 | Renchen | 52/149 |
| 3,830,024 | 8/1974 | Warnke | 52/23 |
| 3,845,597 | 11/1974 | Foster | 52/166 |

OTHER PUBLICATIONS

"Manufactured Housing Anchoring Installation Information Provided by Tie Down Engineering", pamphlet, 5 pages.
"Ironroot Earth Anchors" by Tie Down Engineering, pamphlet, 3 pages.
Manufactured Housing Institute Memorandum from Frank Walter, Jan. 10, 1995, "NIST Study on Manufactured Home Anchoring Systems", 55 pages.
"Laboratory Testing of Soil Anchors for U.S. Department of Housing and Urban Development Washington, DC" from HUD User's Document Reproduction Service, 47 pages.
"NISTIR 5664 Recommended Performance-Based Criteria for the Design of Manufactured Home Foundation Systems to Resist WInd and Seismic Loads", Aug. 1995, 69 pages.

*Primary Examiner*—Carl D. Friedman
*Assistant Examiner*—Creighton Smith
*Attorney, Agent, or Firm*—Thomas, Kayden, Horstemeyer & Risley

[57] ABSTRACT

A manufactured home stabilizing foundation system includes a plurality of soil anchors (18) arranged on the outside of the foundation connected by ties (20) to I-beams (16) on the underside of the manufactured home (12). A plurality of cleated plates (22a, 22b) are arranged under the piers upon which the home is supported and the cleated plates are connected to the anchors (18) by outer stabilizer bars (24). The cleated plates are further connected to each other by an intermediate stabilizer bar (90). The resulting system is a plurality of stabilizer systems crosswise of the home, each including a pair of opposed anchors, a pair of outer stabilizer bars, a pair of piers, cleated plates, and an intermediate stabilizer bar. With the system, forces on one side of the home can be transferred through the system to the anchor on the other side of the home. A bracket (140) connects the outer stabilizer bar to the anchor.

16 Claims, 5 Drawing Sheets

MANUFACTURED HOME STABILIZING FOUNDATION SYSTEM

FIELD OF THE INVENTION

The present invention relates to a stabilizing foundation system for a manufactured home. The foundation system is formed with anchors which penetrate the ground adjacent the home and with straps which are connected between the anchors and the lower frame of the home. The invention further provides a stress pre-loadable tie down anchor.

BACKGROUND OF THE INVENTION

Manufactured homes, such as mobile homes, trailers, prefabricated houses, and the like are manufactured at a central manufacturing site and upon completion are moved to a location where they are occupied. Because these homes are designed to be easily moved from one site to another, they are not built on a permanent foundation but, rather, are typically placed on piers such as concrete blocks, pilings, or stabilizing jacks. If the home is not anchored securely in position, it can be shifted from its position on such blocks or jacks by strong winds or earth tremors. This can cause not only serious damage to the home itself but may also cause human injury. Another potential danger is the breakage of gas pipes and subsequent ignition of escaping gas.

Various types of stabilizing devices have been used to stabilize the homes, to keep the homes from moving in response to wind forces and earth movement, such as guy wires or straps tying the home to ground fixtures or anchors either permanently or temporarily inserted in the ground.

A traditional approach to providing windstorm protection for manufactured homes consists of an anchor having a shaft with one or more helical plates at the bottom of the shaft which can be rotated to move into the earth, and cold-rolled steel strapping installed as diagonal ties between the anchor head and the lower main frame of the manufactured home. A system of this type is taught in U.S. Pat. No. 3,747,288. In addition, vertical or "over-the-top" ties may be installed in the case of single-wide structures.

Vertical support for the manufactured home is provided by concrete masonry piers or by prefabricated steel or pro-cast concrete jackstands located under each longitudinal beam of the main frame of the home and spaced longitudinally at 2.44 m (8 ft) or more center-to-center. For convenience, the piers and anchoring components usually are installed after the home is moved into its final position. As a consequence, the soil anchors are installed vertically or even with a slight back-angle just inside the perimeter of the home.

The portion of the anchor shaft of a typical soil anchor which is beneath and adjacent the surface of the soft has a relatively small surface area that contacts the soil. When the upper end of the anchor shaft is pulled laterally by a manufactured home being pushed by the wind, the upper portion of the anchor shaft usually is met with only small soil resistance, and the upper portion of the shaft tends to move through the soil and bend toward the manufactured home, allowing the home to move. Once the anchor has become bent toward the home, its resistance to horizontal movement increases.

One way of increasing resistance to the movement of the upper shaft portions of soil anchors without bending the anchors has been to drive a large stabilizer plate into the soil adjacent the anchor and between the anchor and its home, which spreads the pulling force applied by the strap to the anchor over a larger area in the soil.

Another way of increasing the resistance of the upper shaft portion of the soil anchors is to preload the anchors, by deliberately bending the upper ends of the anchor shafts toward the home when the anchors are first installed so that the bending of the shaft will have been accomplished prior to the lateral forces being applied by the wind to the house.

Test data for this type of installation have been developed, and the performance of traditional anchor systems has been reviewed. It was shown that the load capacity and stiffness of helix-plate soil anchors generally are far less than what is required to provide adequate resistance against the loads resulting from wind storms and acting on the diagonal ties and the piers.

Based on extensive laboratory and field studies, the expectations for the performance of traditional anchoring systems are higher than the actual levels of resistance that the anchoring systems can reasonably be expected to provide.

The large horizontal displacements required to bend the anchors and therefore develop acceptable levels of anchor resistance are incompatible with the much shorter horizontal displacement limits of the home which are needed to ensure pier stability to support the home.

Stabilizer plates and similar devices which are installed adjacent the head of an anchor exhibit low mean resistance and high variability to anchor head movement which makes them minimally effective for increasing the lateral resistance of soft anchors.

The U.S. Department of Commerce, Department of Housing and Urban Development, recently released a report, NISTIR 5664, entitled "Recommended Performance-Based Criteria for the Design of Manufactured Home Foundation Systems to Resist Wind and Seismic Loads," (August 1995). This report recommends that preloaded soft anchors be used. By pre-loading it is meant that the anchor is bent prior to use in the direction of the mobile home until it resists a certain mount of force, typically 3,000 pounds. The strap extending between the anchor head and the lower frame of the home is then tightened. In particular, pre-loading can produce a significant increase in anchor stiffness, thus eliminating the need for stabilizer plates and similar devices which have been shown to be largely ineffective. The limited test data that are available for cold-rolled steel strapping suggest an in-service ultimate capacity of about 16.9 kN (3,800 lbf). The factored diagonal tie load for a basic wind speed of 44.7 m/s (100 mph) is 7.55 kN/m (518 lbf/ft), resulting in a maximum anchor spacing of 2.24 m (7.3 ft). However, at higher wind speeds the anchor spacing becomes so small that the cones of influence of the helix plate in the soil begin to overlap significantly. Therefore, even with pre-loading, the traditional shallow anchor/tie/pier system is limited in application to basic wind speeds less than about 44.7 m/s (100 mph).

What is needed but, apparently, is not available, is a foundation stabilizing system for manufactured homes that provides improved resistance to horizontal movement as well as resistance to vertical displacement of the traditional soil anchor.

SUMMARY OF THE INVENTION

Briefly described, the present invention is a stabilizing foundation system for a manufactured home mounted upon piers, wherein the piers are supported by the ground and usually are arranged in pairs with the pairs of piers being spaced along the length of the manufactured home. The home typically is constructed on a lower frame which includes a pair of parallel I-beams extending along the length of the home. The I-beams rest on the pairs of piers positioned beneath the home, with the piers bearing the full weight of the home. In the situation where two home units are placed side-by-side to form a "double wide" structure, there usually will be separate pairs of I-beams and piers for each home unit.

The stabilizing foundation system includes soil anchors inserted into the ground at the outside of and aligned with the pairs of piers to form an anchor-piers-anchor alignage. Outer stabilizer bars are positioned flat on the ground and extend between and abut the anchors and their associated piers. Tension straps connect the anchors to the lower frame of the manufactured home. Therefore, an anchor, embodied in the soil, a strap extending between the head of the anchor and the frame of the home, a pier supporting the home, a stabilizer bar having its ends in abutment with the anchor and the pier, and the weight of the home bearing upon the pier act in combination to resist movement of the home. The lateral force of the wind blowing against the home is resisted by the anchor and the strop, and the forces on the anchor applied by the strap are partially transferred by the stabilizer bar to the pier and movement of the stabilizer bar is resisted by the pier.

An intermediate stabilizer bar can be placed between the piers of a pair of piers so that a pair of anchors, a pair of straps, a pair of piers, a pair of outer stabilizer bars, and an intermediate stabilizer bar form a foundation system that extends across the manufactured home so that wind force on one side of the home is resisted by the anchor on that side as well as the anchor on the opposite side.

A novel aspect of the invention is the use of the literal wind forces to increase the effective weight of the manufactured home on the windward piers beneath the home in combination with the anchor, strap and compression bar.

Because the combination of the upwind anchors and their upwardly inclined straps extending to the lower frame of the home at the adjacent pier, the lateral forces applied by the wind to the home tend to tighten the inclined strap. This tightening of the inclined straps tends to pull the lower frame of the home downwardly against the adjacent pier. The anchor which is connected to the lower end of the strap tends to bend toward the home in response to the pull of the strap; however, the compression bar abuts between the anchor and the adjacent pier, resisting the bending of the anchor. In the meantime, the additional downward force applied by the strap to the home and to the adjacent pier assures that the pier will not be displaced by the compression bar. This arrangement causes the horizontal wind forces to be used to increase the resistance of the foundation system against lateral shifting of the home.

The system can further include at least one stabilizing cleated plate placed beneath a pier, wherein the cleated plate has an upwardly facing planar surface which functions as a platform for receiving the pier, and cleats extend downwardly from the platform for penetrating the ground surface. The cleated plate has receptacles for engaging the ends of the stabilizer bars of the stabilizing foundation system to assure that the stabilizer bars are always maintained in alignment with the piers.

An innovative pier mounting system is used for attaching the stabilizing foundation system to at least one stabilizer plate and a wooden 4"×4" post. A means for attaching the stabilizing foundation system to a soil anchor is disclosed.

An improvement in a pier post adjuster is taught that provides means for attaching the metal tension strap to the manufactured home without crimping or folding and thereby weakening the tension strap. Means for looping the strap and providing a double strap from the pier post adjuster to the tensioning head of the soil anchor is taught. This allows for twice the holding strength of a single strap, by dividing the load.

Thus, it is an object of this invention to provide a stabilizing foundation system for transferring at least a portion of the lateral wind force exerted upon a manufactured home from the home to a soil anchor and to an adjacent pier held down by the weight of the manufactured home.

Another object of this invention is to provide a stabilizing foundation system for transferring at least a portion of the lateral wind force exerted upon a manufactured home from the anchor on the windward side of the home to the anchor on the leeward side of the home and thus providing the home with greater wind resistance.

A further object of this invention is to provide a stabilizing foundation system for a manufactured home that includes cleated stabilizing plates under the piers of the home and a diagonal tie connected between a soil anchor and the frame of the home so that a portion of the lateral force of the wind is transferred downwardly to the cleated plate and therefore the resistance to horizontal movement of the home from wind force is increased.

Another object of this invention is to provide a cleated plate for use under a pier supporting the weight of a manufactured home, wherein the plate is held down by the weight of the home and resists movement of the pier over the ground.

A still further object of this invention is to provide an inexpensive stabilizing foundation system for a manufactured home utilizing a traditional soil anchor wherein the pullout forces applied to the anchor are maintained in an approximate vertical direction.

Another object of the invention is to provide means for doubling the strap from the tensioning head of the anchor to the manufactured home so as to increase the resistance of the strap by dividing the load.

Other objects, features, and advantages of the present invention will become apparent upon reading the following specification, when taken in conjunction with the accompanying drawings.

DETAILED DESCRIPTION

Figure 1:
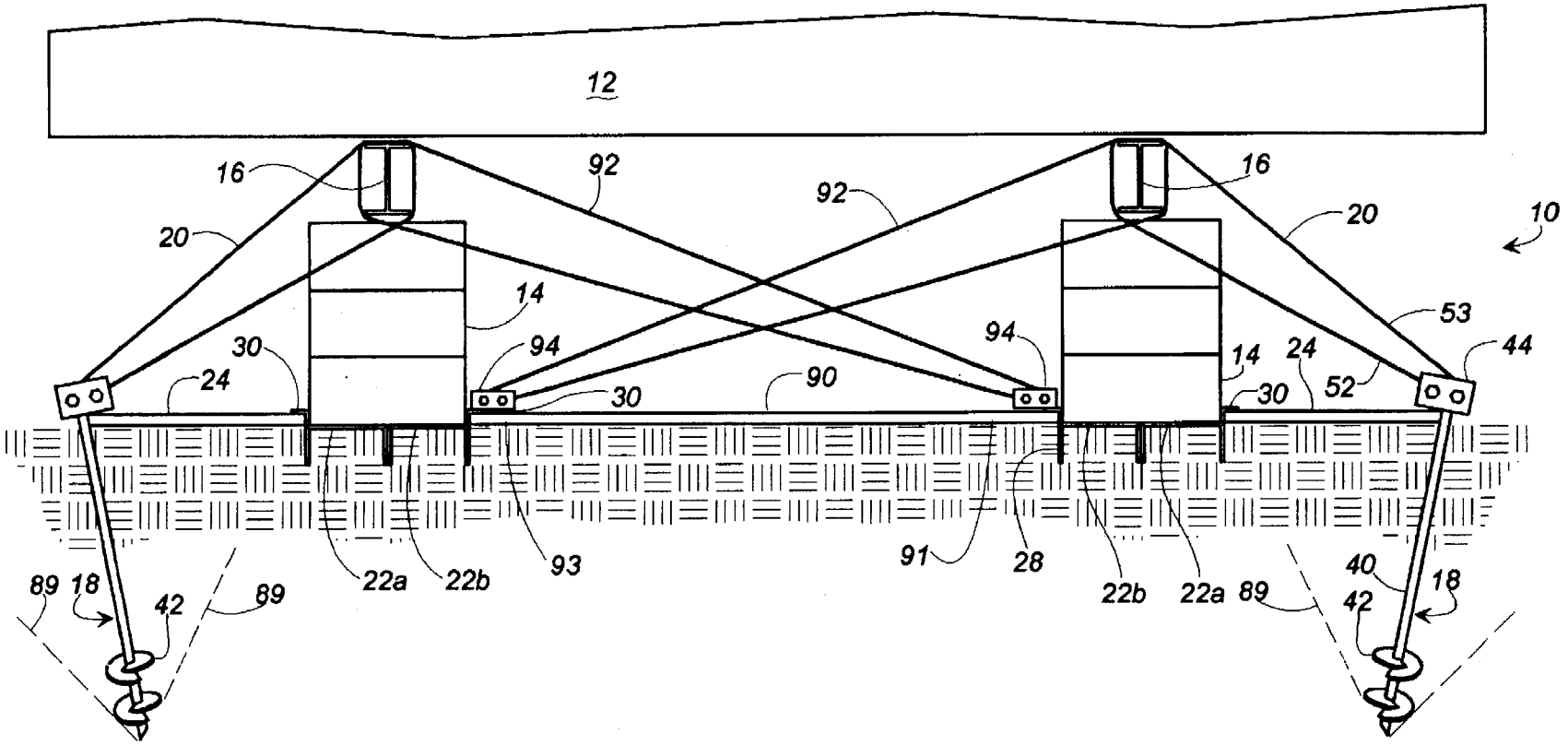
FIG. 1 is a side elevational view of a manufactured home utilizing a stabilizing foundation system of the present invention.

Referring now in more detail to the drawings, in which like numerals refer to like parts throughout the several views, FIG. 1 illustrates a stabilizing foundation system 10 for a manufactured home 12. The manufactured home 12 typically is supported upon a plurality of piers 14 by one or more parallel I-beams 16 that are attached lengthwise to the under carriage of home 12. The I-beams function as the lower frame of the home. Manufactured home 12 includes cross braces or joists on the under side thereof (not shown), upon which I-beams 16 are supported. As a result, there are spaces between the underside of home 12 and I-beams 16.

A plurality of soft anchors 18 are inserted into the ground, typically with an anchor adjacent the outside of each pier 14. Thus, a pair of anchors 18 and a pair of piers 14 are aligned across the manufactured home 12. Typically, a pair of piers are placed every eight feet or so along the length of the manufactured home 12. A strap 20 which functions as a fie is attached between each soil anchor 18 and an I-beam 16 at a location on the I-beam adjacent where I-beam 16 contacts pier 14. Strap 20 may be a flat metal strap or other fastening fie. In prior art systems, strap 20 is wrapped at one of its ends around I-beam 16 and secured with a buckle that attaches the end of the strap to the body of the strap.

The above description is generally applicable to prior art anchoring systems which, as discussed above in the introduction, have been shown to be inadequate in preventing displacement of the manufactured home due to horizontal forces exerted by high winds and earth tremors. In the present invention, a method of stabilizing the soil anchors 18 and preventing the soil anchors 18 from moving through the soft is provided, and a method of transferring force exerted upon a soft anchor 18 on one side of the home toward the soil anchor on the opposing side of the home using a series of compression members is provided.

In the embodiment of the invention shown in FIG. 1, a pair of stabilizers, or cleated plates **22*a*, 22*b* are shown beneath each pier 14. The plates 22 are arranged side-by-side. Pier 14 is shown as a stack of concrete blocks, measuring in length and width about 16" by 8". A compression member, such as an outer rectilinear stabilizer bar 24, is placed between cleated plate 22*a* and soil anchor 18. Outer stabilizer bar 24 is retained tightly between cleated plate 22*a* and soft anchor 18 so that forces exerted upon soft anchor 18 by wind blowing against manufactured home 12 and the strap 20 pulling the anchor will be transferred to cleated plate 22*a*. In addition, because cleated plates 22*a*, 22*b* are in contact with pier 14 some lateral force exerted by the stabilizer bar 24 is received by pier 14. The weight of mobile home 12 upon pier 14 and cleated plates 22*a*, 22*b* helps prevent pier 14 and plates 22*a* and 22*b*** from shifting.

Figure 6:
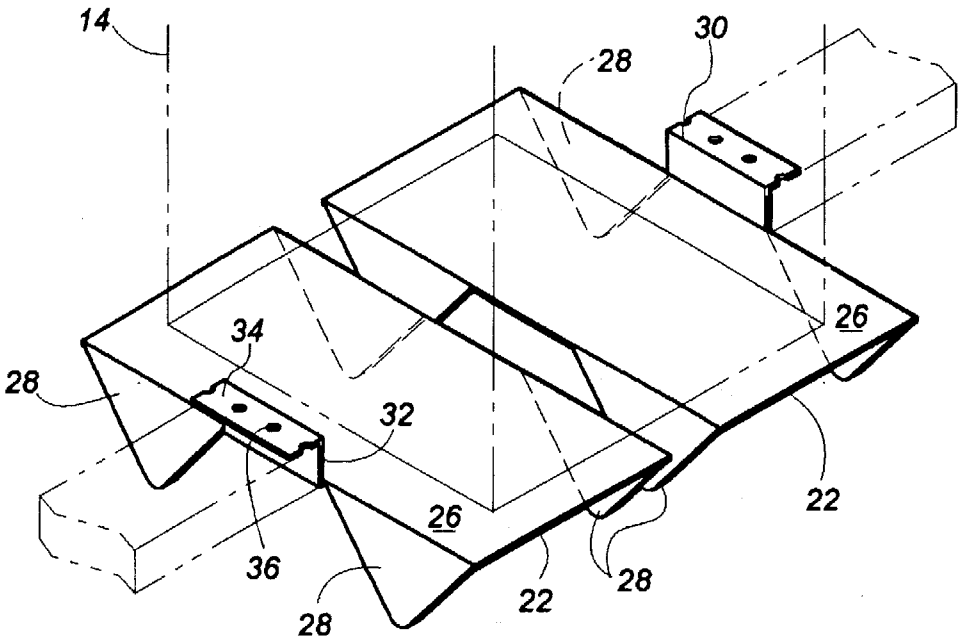
FIG. 6 is a view of the cleated plate of FIG. 1, and shows means of mounting a concrete pier and stabilizer bars of the present stabilizing foundation system to the cleated plate and pier.

A cleated plate 22, shown more clearly in FIG. 6, includes a substantially planar platform 26 upon which concrete pier 14 is supported. A plurality of triangular cleats 28 extend from opposed side edges of platform 26 in one direction, substantially perpendicular to platform 26. These cleats 28 extend into the ground upon which cleated plate 22 is placed. Cleated plate 22 is preferably made from a steel sheet and further includes fastening means to fasten the outer stabilizer bar 24 to cleated plate 22.

In the embodiment shown in FIGS. 1 and 6, outer stabilizer bar 24 is a wooden two by four and the fastening means includes a right angular tab 30 having an upright potion 32 extending perpendicularly from platform 26 in a direction opposite that of cleats 28 and a lateral potion 34 extending generally parallel to platform 26 and extending outwardly from potion 32. Lateral potion 34 includes holes 36 so that a nail or other fastener can be driven through the lateral portion an into outer stabilizer bar 24.

Figure 2:
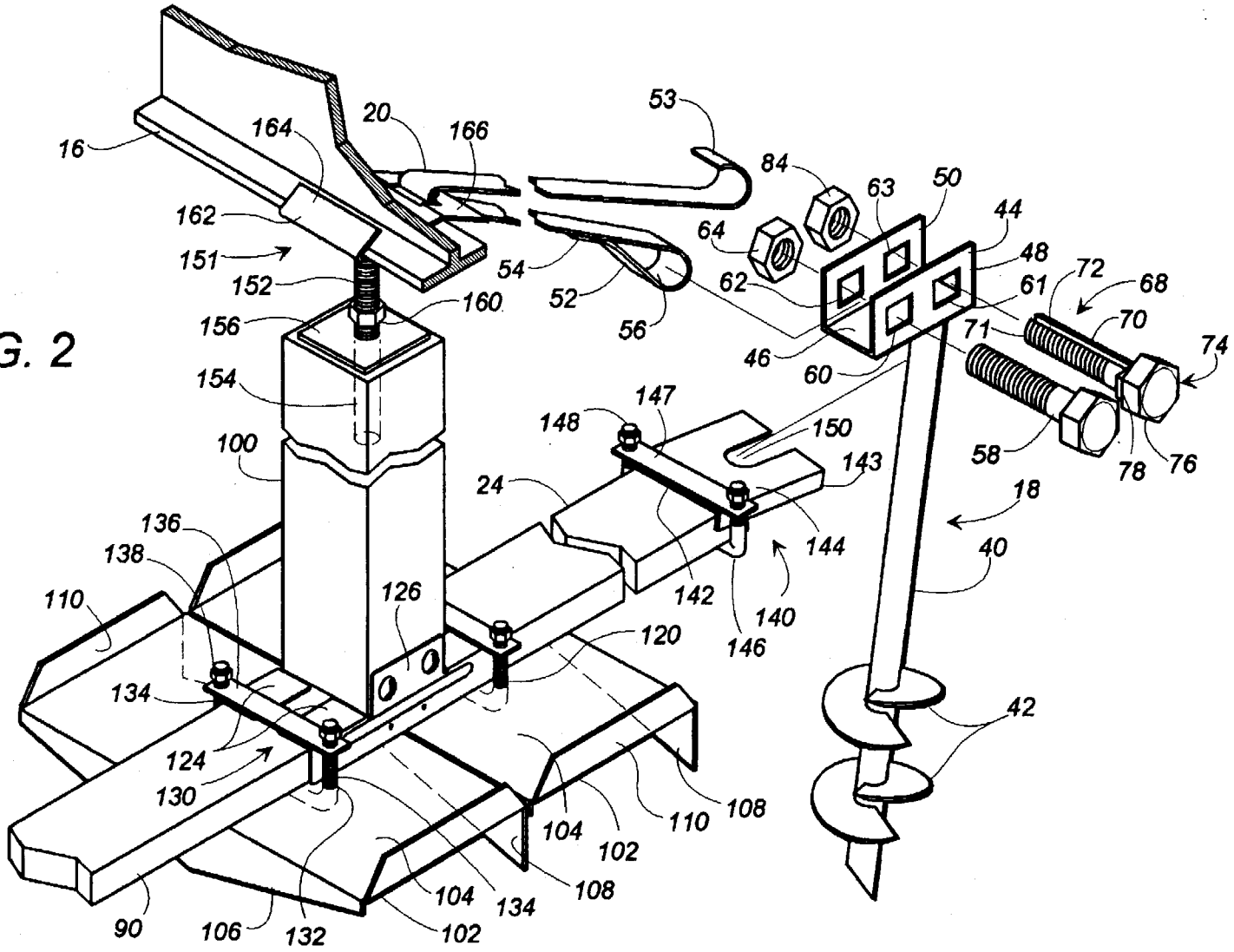
FIG. 2 is a perspective, partially exploded view of a pier mounting system of the present invention for attaching a wooden pier to a pair of cleated plates and showing a soil anchor, and the structure for double strapping the anchor tensioning head to the manufactured home.

As illustrated in FIGS. 1 and 2, soil anchor 18 which is standard in the field includes anchor shaft 40 having welded thereto auger or helix plates 42 which engage the soil and retain the anchor within the soil. A tensioning bracket 44 is welded to the top end of anchor shaft 40, and, as shown more clearly in FIG. 2, includes a bottom wall 46 which is welded to shaft 40. Tensioning head 44 further includes two upstanding side walls 48, 50 that extend substantially perpendicularly to bottom wall 46. A pair of square shaped apertures 60, 61 in wall 48 are aligned with apertures 62, 63 in wall 50.

Strap 20, also shown more clearly in FIG. 2, preferably comprises a thin metal strap that attaches to I-beam 16 and to the tensioning head 44 of the anchor 18. Preferably, in the embodiment of FIG. 1, each end 52 and 53 of metal strap 20 attaches to tensioning head 44 and the intermediate potion of the strap wraps around or clips to I-beam 16. A first end 52 of strap 20 is welded back onto itself at weld point 54 so that loop 56 is formed. Loop 56 is retained in tensioning head 44 by bolt 58 which passes through aperture 60, loop 56, and aperture 62 of tensioning head 44 and is secured tightly by nut 64.

The second end 53 of strap 20 is retained in the tensioning head 44 by bifurcated carriage bolt 68 which includes arms 70 and 71 having a groove 72 therebetween. Head 74 of carriage bolt 68 includes a generally hexagonal portion 76 that extends over and forms a flange over square portion 78. In use, carriage bolt 68 is inserted through aligned apertures 61 and 63 of tensioning head 44. Nut 84 is loosely threaded onto carriage bolt 68, and the end 53 of strap 20 is inserted into groove 72. A torque wrench or other means is used to rotate carriage bolt 68 so that strap 20 is wound about carriage bolt 68. When strap 20 is pulled to the desired tension, carriage bolt 68 is adjusted so that square portion 78 seats in square aperture 61. Nut 84 is then lightened so that carriage bolt 68 is nonrotatably held within tensioning head 44 and strap 20 is held tightly between I-beam 16 and tensioning head 44. By providing a double strap 20 in this way, the strength of the strap is approximately doubled and twice the amount of resistance is provided.

In the embodiment of the invention shown in FIG. 1, rectilinear stabilizer bar 24 extends between and abuts the anchor 18 and its pier 14. This arrangement, and stress exerted on anchor 18 by strap 20 due to lateral wind forces against home 12 is transferred via outer stabilizer bar 24 to cleat plate 22 and pier 14. Further, anchor 18 is prevented from bending and moving horizontally through the soil toward the manufactured home by the abutting stabilizer bar and all of the anchor's pull-out resistance to the force of strap 20 is in a vertical direction. Therefore, the entire cone of influence 89 of anchor 18 resists vertical pull-out of anchor 18 through the soil. Further, anchor 18 becomes preloaded against horizontal displacement.

In the stabilizing foundation system shown in FIG. 1, an intermediate rectilinear stabilizer bar 90 is placed between the pair of piers 14 so that one end 91 of the bar is retained by tab 30 of cleated plate **22*b* of pier 14 and the other end 93 of the bar is retained by tab 30 of cleated plate 22*b* of the opposing pier 14. In this manner, the wind force on one side of manufactured home 12 will be transferred through the strap 20, anchor 44, the stabilizer bar 24, pier 14 and its cleated plates 22a and 22b, intermediate stabilizer bar 90 to the cleated plates 22a, 22b and the pier 14 on the opposing side of manufactured home 12. Further, because of the substantially continuous foundation system of the two outer stabilizer bars 24 and the intermediate stabilizer bar 90, some of the force on one anchor 18 from wind on that side, the windward side, of the home 12 will be transferred all the way through the system to and resisted by the opposing anchor 18 on the other side, leeward side, of home 12**.

In the embodiment shown in FIG. 1, additional optional straps are included to provide additional protection against movement of the manufactured home in areas with frequent earth tremors. Strap means 92 extends from a tensioning box 93 welded to the horizontal portion 34 of tab 30 of cleated plate 22b and around I-beam 16. Straps 92 are fastened to tensioning box 94 as previously described for strap 20 and tensioning bar 44.

While FIG. 1 shows the stabilizing foundation system as having a pair of soil anchors, a pair of outer stabilizer bars, an intermediate stabilizer bar, a pair of concrete piers, and two pairs of cleated plates, it is anticipated that alternate embodiments of the invention may be used, as illustrated in the additional drawings and described below. Other than those specific embodiments shown and described, however, it is anticipated that other embodiments may be employed. For example, elements of the embodiment shown in FIG. 1 may be used to retrofit an existing, installed manufactured home 12 with a stabilizing foundation within the metes and bounds of the present invention. A prior art installed manufactured home may already have a ground anchor stabilizing system that includes a plurality of pairs of piers, soil anchors, stabilizer plates, I-beams, and straps as described above and generally known in the art. To retrofit the home foundation system in accordance with the preset invention, a pair of outer stabilizer bars 24 can be cut to length and adapted to tightly fit between piers 14 and soil anchors 18 and thus function to transfer the force from soil anchor 18 to pier 14 and keep soil anchor 18 from slicing through the soil. Similarly, an intermediate stabilizer bar 90 can be cut to length and installed between piers 14 where it will act to transfer force from a windward pier and soil anchor 18 to leeward pier and soil anchor 18.

Further, a soil anchor 18 having a tensioning head 44 as described above may be used to retrofit a previously installed manufactured home 12 so as to enable doubling of strap 20.

Figure 3:
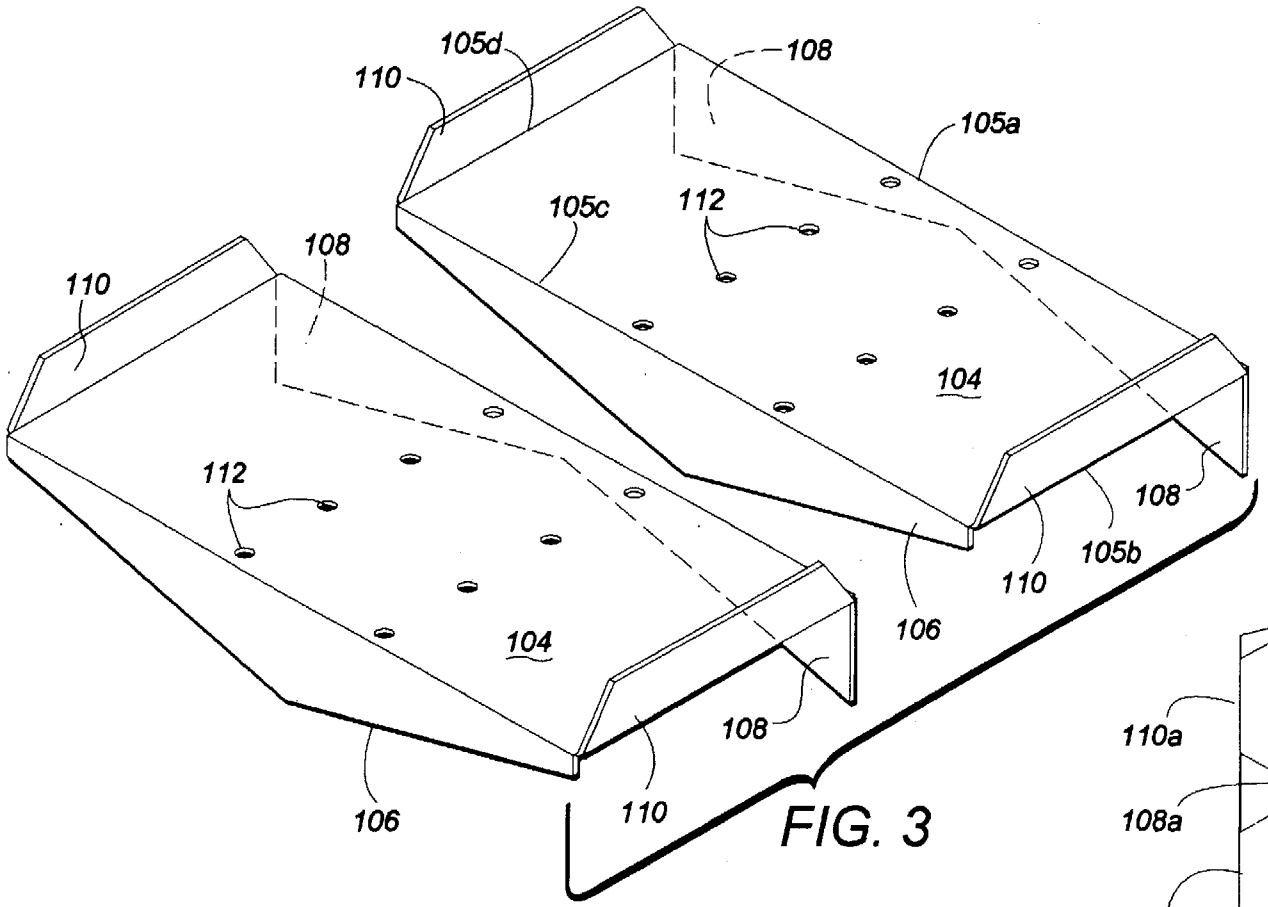
FIG. 3 is a perspective view of a pair of cleated plates of the present invention.
Figure 4:
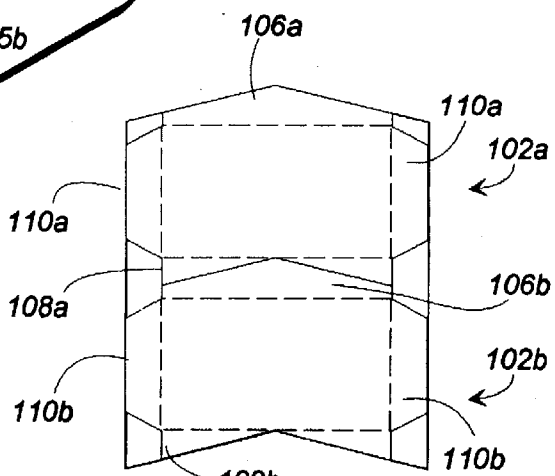
FIG. 4 is a view of the sheet metal used to form the cleated plates of FIG. 3 as marked upon a sheet of metal prior to being formed into cleated plates.

FIG. 2 illustrates an alternate embodiment of several aspects of the invention shown in FIG. 1. Rather than concrete piers as in FIG. 1, the embodiment of FIG. 2 employs wooden 4" by 4" four-sided posts 100 that are supported upon cleated plates 102. The cleated plates 102, shown more clearly in FIGS. 3 and 4, comprise a generally planar platform 104 with side edge portions 105a, 105b, 105c, 105d thereabout. A generally triangular cleat 106 extends perpendicularly downward from side edge portion 105c of platform 104. A pair of approximately right triangular cleats 108 extend downwardly from the opposed side edge portion 105a of platform 104. Cleats 106, 108 will be fully inserted into the ground when the bottom of platform 104 rests against the ground. Side walls 110 extend upwardly on the remaining, opposed side edge portions 105b, 105d of platform 104 and function to increase the strength of platform 104. A plurality of pairs of holes are defined in platform 104 arranged from side edge 105a to side edge 105c. A method of forming cleated plates 102 from a single sheet of metal is shown in FIG. 4. The cleats 108a of one stabilizing plate 102a interfit with the cleat 106b of a second stabilizing cleated plates 102b. The plate are fashioned from twelve gauge steel and each resulting plate can measure about sixteen inches by about eight and one-half inches.

Figure 7:
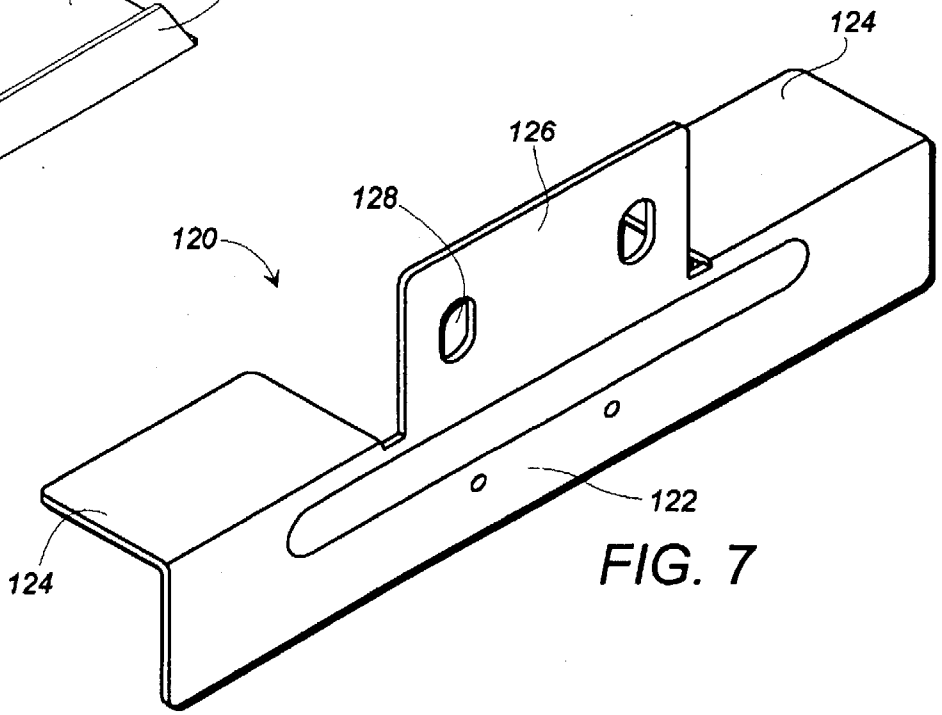
FIG. 7 is a perspective view of the post support angle of the post mounting means shown in FIG. 2.

As shown in FIG. 2, post 100 is mounted straddling two cleated plates 102a, 102b. Outer stabilizer bar 24 and intermediate stabilizer bar 90 are positioned so that an end of each are aligned and are positioned on top of cleated plates 102a, 102b and next to or near post 100. A pair of pier post support angles 120 are used to retain post 100, intermediate stabilizer bar 90, and outer stabilizer bar 24 to each other and to cleated plates 102. Pier post support angle bracket 120, shown more clearly in FIG. 7, includes a generally rectangular brace 122 with three tabs along one side thereof. Two outside tabs 124 are folded down so that they are perpendicular to portion 122 and central tab 126 extends upwardly, parallel with portion 122. A pair of apertures 128 in central tab 126 receive fastening means such as nails or bolts to fasten bracket 120 onto post 100. As shown in FIG. 2, two brackets are installed on opposing sides of post 100 so that downfolded tabs 124 form two channels 130 on two opposing sides of post 100 that are sized and shaped to receive the ends of outer stabilizer bar 24 and intermediate stabilizer bar 90 that are positioned on top of cleated plates 102a, 102b, respectively.

To tightly hold stabilizer bars 24 and 90 to cleated plates 102a, 102b, U-bolts 132 are inserted upwardly through holes 112 of cleated plates 102a and 102b so that arms 134 of U-bolt 132 extend upward from the ground, on the outside of channels 130. Outer stabilizer bar 24 and intermediate stabilizer bar 90 are inserted between post support angles 120 and fastening plate 136 is installed so that two holes in its opposing ends fasten over arms 134 of U-bolt 132. Nuts 138 are then screwed onto threaded ends of arms 134 and are tightened so that the U-bolts and the fastening plates 136 grip the ends of the stabilizer bars. Stabilizer bars are thus connected to cleated plates 102 as well as to post 100.

Anchor bracket 140, shown in FIG. 2, serves to couple outer stabilizer bar 24 to soil anchor 18. Anchor bracket 140 includes a collar 142 for mounting to the end of a stabilizer bar 24 and an inclined skirt 144 for engaging an anchor shaft. Downward extending edges 143 are located on opposed sides of the collar and skirt. The end of stabilizer bar 24 is accepted by the channel formed by collar 142 and its downturned edges 143, and the end of the stabilizer bar is retained therein by a U-bolt 146, fastening strap 147, and nuts 148. Downsloping skirt 144 includes a groove 150. Shaft 40 is received by groove 150 and anchor 18 is lightened into the ground so that the bottom wall 46 of tensioning head 44 rests against skirt 144.

Figure 8:
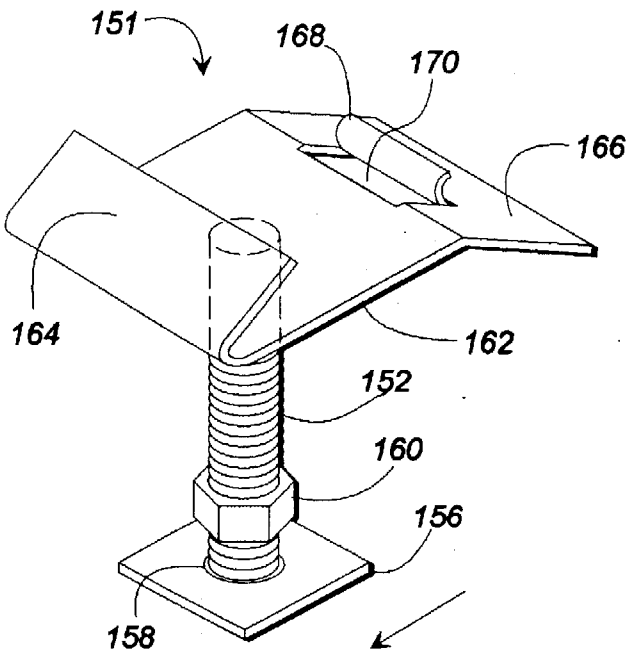
FIG. 8 is a perspective view of the post adjustor shown in FIG. 2, for attaching the strap to the manufactured home.

In the embodiment shown in FIG. 2, strap 20 is fastened to a post adjustor 151 rather than being wrapped around the I-beam as shown in FIG. 1. Post adjustors have been used in the prior art to couple a pier such as post 100 to I-beam 16 when post 100 is not long enough to control I-beam 16. In particular, because the ground under the manufactured home may be uneven and posts will generally be provided in a certain length, there is oftentimes a need to provide a few inches of connecting support. Post adjustor 151, shown more clearly in FIG. 8, includes threaded shaft 152, which is received in bore 154 (see FIG. 2) of post 100. Plate 156, having central aperture 158, rests upon the top surface of post 100 and receives shaft 152 therethrough. A nut 160 threads onto threaded shaft 152 and rests against plate 156. Thus, adjustment of nut 160 will raise or lower shaft 152 within bore 154. I-beam clip 162 is welded onto the upper end of threaded shaft 152. One edge of clip 162 curves upwards to form an upturned edge 164 that grasps I-beam 16. Opposing end 166 of clip 162 slopes downwards from receiving plate 162 and an central rectangular portion of downsloping edge 166 is struck out so that a upwardly extending generally curved tab 168 is formed in downsloping edge 166. Strap 20 is passed through the aperture 170 and wrapped around the tab 168 to therefore fasten strap 20 to post adjustor 151 and I-beam 16. This fastening means is preferable to prior methods of fastening a strap by wrapping the strap around the I-beam because sharp bending of strap 20 is avoided, which bending may cause weakening or even breakage of strap 20.

Figure 5:
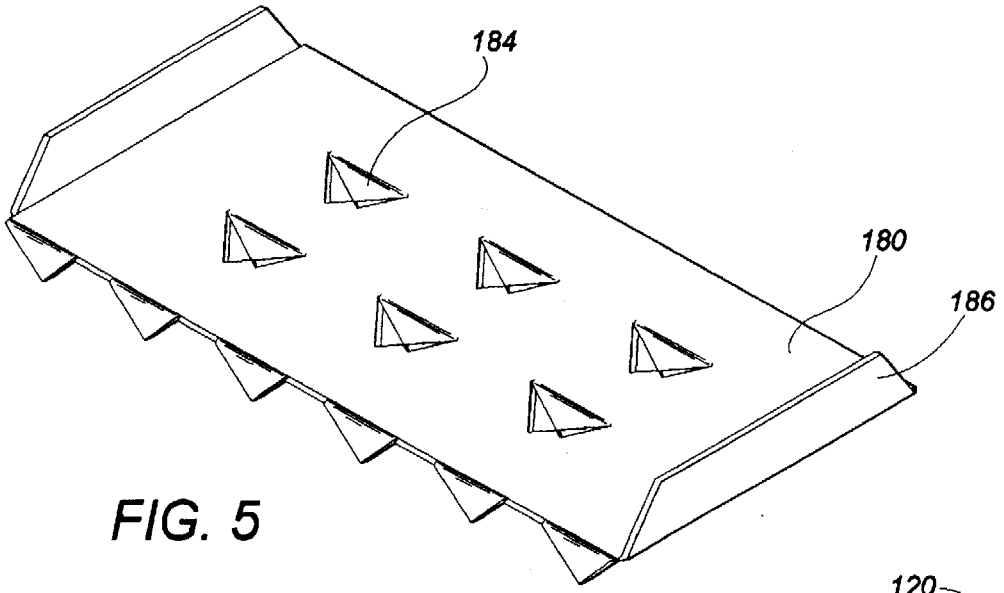
FIG. 5 is a view of an alternate embodiment of a cleated plate.

A third embodiment of a cleated plate is shown in FIG. 5. Cleated plate 180 includes substantially planar platform 182 having triangular struck out portions 184 therein. Struck out portions 184 protrude downwardly, forming cleats for engagement with soil. Opposing side edges of platform 182 may also have triangular extensions that are bent downwards to form cleats. The other opposing side edges of platform 180 are turned upwards to provide strength to the cleated plate 180.

OPERATION

The present invention provides increased resistance to vertical displacement of the soil anchors. The compression members in the form of rectilinear stabilizer bars abut and prevent the soil anchors from moving horizontally toward the manufactured home and therefore cause all of the pull-out force on the soil anchors to be applied in an approximate vertical plane and positions the soil anchor to a preloaded geometry. Therefore, the entire vertical cone of influence of the anchor in the soil is utilized in preventing vertical pull-out of the anchor.

The aspect of effectively preloading the soil anchors by preventing their horizontal movement is an important aspect of the present invention. It has been recommended by HUD that anchors be preloaded to avoid their horizontal displacement through the soil when the home is blown by wind and shifts on its piers. While preloading has been recommended, the prior method of doing so actually intentionally bends the anchor shaft which can cause weakening of the soil anchor. The present invention allows preloading of the anchor without bending the anchor shaft.

The main frame of a manufactured home experiences negative windward support, or corresponding net uplift forces to the windward side of the home when subjected to windward windloads of 75 mph. This net uplift force on one side of the home is transferred into downward forces on the leeward side of the home.

The present invention uses these "dynamic forces" to increase the horizontal support of the home as the wind lead increases on the windward side. The increase in the leeward pier support adds to the leeward cleated plates resistance to horizontal displacement as a result of the additional compressive forces being transmitted into the soil beneath the cleated plate. These additional forces on the cleated plate of the leeward pier can be transferred to the leeward anchor through the stabilizer bars.

The present method of connecting the soil anchor to the adjacent cleated plate and pier offers another advantage. The resistance to horizontal displacement on the windward cleated plate tends to increase as the windload on the windward side of the home increases. A review of vector analysis reveals that as the horizontal lead increases, downward vertical force on the windward cleated plates increases because of the inclined strap extending downwardly from the lower frame of the home to the anchor. For example, assuming that the angle of the frame tie connection 20 is 45°, a 1000 lb. horizontal force will generate approximately 700 lb. (0.707 sine) of downward vertical force onto the foundation pad. This downward vertical force will increase as the angle of the frame tie connection increases. For example, if the frame tie connection is 60° (the angle from horizontal to the strap 20) a 1000 lb. horizontal windload will result in 866 lbs. of downward vertical force. This is calculated as: cos 60°=0.866.

While preferred embodiments of the invention have been disclosed in detail in the foregoing description and drawings, it will be understood by those skilled in the art that variations and modifications thereof can be made without departing from the spirit and scope of the invention as set forth in the following claims.

I claim:

1. A stabilizing foundation system for a manufactured home comprising:

piers adapted to be supported by the ground for supporting a manufactured home, wherein the piers are arranged in opposed pairs with the pairs of piers adapted to be spaced along a length of the manufactured home;

a plurality of soil anchors adapted to be inserted into the ground, with pairs of the anchors arranged in straddled association with each pair of piers so that the piers have anchors located outwardly thereof, and so that a pair of anchors and a pair of piers define a straight line;

a plurality of ties, each tie having one end attached to one of said anchors and having a second end for attachment to the manufactured home at a location above the pier associated with said anchor;

a stabilizer plate adapted to be placed on the ground under each pier;

a plurality of outer stablilizer bars each having opposed ends and extending between and in contact at its ends with one of said anchors and the stabilizer plate under the pier associated with the anchor; and a plurality of intermediate stabilizer bars each having opposed ends and extending between and in contact at its ends with each of said stabilizer plates;

wherein each pair of anchors and its outer stabilizer bars, pair of piers, stabilizing plates beneath the piers, intermediate stabilizer bar extending between the piers, and ties define a substantially straight line and form a stabilizing foundation system for a manufactured home.

2. The stabilizing foundation system of claim 1, wherein said stabilizer plate comprises a planar surface receiving the pier and a plurality of cleats adapted to engage the ground.

3. The stabilizing foundation system of claim 1, wherein each of said stabilizer plates includes a pair of brackets securely engaged to the pier, one of the outer stabilizer bars, and the intermediate stabilizer bar.

4. The stabilizing foundation system of claim 2, further including stabilizer plate engagement means which engage said intermediate stabilizer bars with said stabilizer plates, said stabilizer plate engaging means including upwardly extending side walls.

5. The stabilizing foundation system of claim 1, and further including anchor engagement means including a bracket with a portion to accept and securely hold an end of one of said outer stabilizer bars.

6. The stabilizing foundation system of claim 1 wherein said outer stabilizer bar and said intermediate stabilizer bar are wooden planks and the piers are wooden posts.

7. A method of stabilizing a manufactured home mounted upon piers and connected to soil anchors, wherein the piers are arranged in spaced, opposed pairs along a length of the home and a soil anchor is engaged in the soil adjacent each pier, comprising the steps of:

sizing an outer lateral stabilizer to fit between each pier and its adjacent anchor;

placing said outer lateral stabilizer between each pier and its adjacent anchor so that said outer lateral stabilizer is in contact at its opposite ends with the pier and the anchor;

connecting ties between said manufactured home and each of said anchors; and drawing tension in said ties until the anchors are preloaded to a predetermined stress and the outer stabilizers are compressed between the anchors and the pier.

8. The method of claim 7, further comprising the step of sizing an intermediate lateral stabilizer to fit between the opposing piers and placing the intermediate lateral stabilizer between the opposing piers so that the intermediate lateral stabilizer is in contact with the opposing piers.

9. A method of installing a stabilizing foundation system for a manufactured home mounted upon piers supported by the ground, wherein the piers are arranged in spaced, opposed pairs along a length of the manufactured home, the method comprising the steps of:

placing at least one stabilizer plate under each pier;

driving a plurality of soil anchors into the ground about the manufactured home, with the soil anchors being arranged in association with the piers so that each anchor is located outwardly of each pier and so that two anchors and two piers define an approximately straight line across the manufactured home;

attaching a tie between each anchor and the manufactured home at a location above the pier associated with said anchor;

placing an outer stabilizer bar between each anchor and its associated pier so that said outer stabilizer bar is in contact with the anchor and the stabilizer plate of its associated pier; and placing an intermediate stabilizer bar between each pair of piers so that said intermediate stabilizer bar is in contact with a stabilizer plate under each of the pair of piers;

whereby a nearly contiguous stabilizing foundation is formed that includes two anchors, two outer stabilizer bars, at least two stabilizer plates, and an intermediate stabilizer bar.

10. A kit for use in forming a stabilizing foundation for a manufactured home mounted upon piers supported by the ground, wherein the piers are arranged in at least one pair of opposed piers along a length of the manufactured home, the kit comprising:

a pair of soil anchors adapted to be inserted into the ground, outwards of the pair of opposed piers so that said anchors are adapted to define a straight line with the pair of opposed piers across the manufactured home;

a pair of ties for attachment to the manufactured home adjacent each pair of opposed piers, each tie attached to each anchor;

at least two stabilizer plates for placement under the pair of opposed piers;

a pair of outer stabilizer bars adapted to be placed between the anchors and each pair of opposed piers; and an intermediate stabilizer bar adapted to be placed between the pair of opposed piers.

11. A stabilizing foundation system for a manufactured home mounted upon pairs of piers supported by the ground, wherein the pairs of piers are spaced along a length of the manufactured home and support the home, the stabilizing foundation system comprising:

a plurality of soil anchors adapted to be inserted into the ground on opposite sides of the home with each pair of said anchors for respective arrangement in association with each pair of piers, each pair of anchors adapted for straddling a pair of piers;

ties attached to both of said anchors of each pair of anchors and for attachment to the manufactured home at a location above each associated pair of piers;

stabilizer bars extending between each anchor and each of the associated pairs of piers;

so that if the manufactured home moves away from one anchor due to the forces applied by wind, the one anchor is drawn toward its pier by the tie and the stabilizer bar engaging the one anchor resists movement of the one anchor by abutment of its other end against the pier.

12. The stabilizing foundation system of claim 11 and wherein:

said tie is tightened to draw said anchors into compressive relationship with said pier.

13. A stabilizing foundation system for a manufactured home having a predetermined weight comprising:

piers adapted to be supported by the ground and spaced along a length of the manufactured home such that the piers bear the weight of the manufactured home;

pairs of soil anchors for insertion into the ground on opposite sides of and in alignment with at least one pier;

stabilizer bars adapted to extend along the ground between the anchors of each pair of anchors and its respective pier;

ties connected to said anchors and for connection to the manufactured home, the ties drawing said anchors of each pair of anchors toward its respective pier;

so that the weight of the home bearing upon the piers resists movement of the piers, and the stabilizer bars extending from the piers to the anchors resist movement of the anchors and their associated tie toward the pier.

14. A stabilizing foundation system for a manufactured home having a predetermined weight, comprising:

piers adapted to be supported by the ground and spaced along a length of the manufactured home such that the piers bear the weight of the manufactured home;

a soil anchor for insertion into the ground adjacent one of said piers;

a stabilizer bar having opposed ends and extending between and in abutment at its opposed ends with said pier and said anchor; and a tie connected to said anchor and for connection to said manufactured home, the tie drawing said anchor toward said pier and into compression with said stabilizer bar;

so that the weight of the home bearing upon the pier resists movement of the pier;

and the stabilizer bar extending from the pier to the anchor resists movement of the anchor and the tie toward the pier.

15. A stabilizing foundation system for a manufactured home comprising:

piers supported by the ground for supporting a manufactured home;

first and second soil anchors positioned in the ground on opposite sides of said piers;

ties connected each at one end to one of said first and second anchors and sloped upwardly for connection at its other end to said home; and compression means having opposed ends and extending between and engaging at its opposed ends said anchors and said piers;

so that lateral movement of said manufactured home in response to wind force is resisted by the transmission of force from said first anchor and its tie, through the compression means, the piers and to the second anchor.

16. A stabilizing foundation system for supporting a manufactured home on the ground comprising:

first and second piers supported on the ground for supporting the manufactured home, a compression bar extending between and engaging at its ends said first and second piers at the ground;

first strap means connected at one of its ends to said first pier adjacent the ground and extending upwardly from said first pier to a position above said second pier for connection to the manufactured home above said second pier; and second strap means connected at one of its ends to said second pier adjacent the ground and extending upwardly from said second pier to a position above said first pier for connection to the manufactured home above said first pier.

* * * * *